United States Patent [19]

Dufour

[11] Patent Number: 4,513,922

[45] Date of Patent: Apr. 30, 1985

[54] AUTOMATIC MACHINE FOR COILING DOWN CABLE

[76] Inventor: Jacques Dufour, 27 rue Gerschell, 62100 Calais, France

[21] Appl. No.: 534,057

[22] Filed: Sep. 20, 1983 (Under 37 CFR 1.47)

[30] Foreign Application Priority Data

Sep. 20, 1982 [FR] France ..... 82 15770

[51] Int. Cl.[3] ..... B21C 47/00

[52] U.S. Cl. ..... 242/54 R; 242/83

[58] Field of Search ..... 242/83, 82, 81, 54 R; 254/382

[56] References Cited

U.S. PATENT DOCUMENTS

| | | | |
|---|---|---|---|
| 1,657,308 | 1/1928 | Jesperson . | |
| 2,936,509 | 5/1960 | Martin | 242/83 X |
| 3,236,467 | 2/1966 | Short et al. | 242/83 |
| 4,109,879 | 8/1978 | Properzi | 242/83 X |
| 4,145,014 | 3/1979 | Chatard et al. | 242/83 |
| 4,172,375 | 10/1979 | Rushforth et al. | 242/83 X |

FOREIGN PATENT DOCUMENTS

| | | |
|---|---|---|
| 1384101 | 11/1964 | France . |
| 88593 | 1/1967 | France . |
| 1027544 | 4/1966 | United Kingdom . |

*Primary Examiner*—John M. Jillions

*Attorney, Agent, or Firm*—Sughrue, Mion, Zinn, Macpeak & Seas

[57] ABSTRACT

An automatic machine (5) for coiling down successive layers of cable (2), e.g. part-completed electric cable during manufacture, in a cylindrical storage tank (1) having a vertical axis. The machine comprises: a movable beam (6) to enable coiling down to take place in a selected one of a plurality of tanks; a rotary arm (7) suspended from the beam and rotatable about an axis which is movable by the beam into alignment with the axis of said selected tank; a parallelogram linkage (30) fixed to the free end of the rotary arm, said parallelogram linkage including a vertically fixed vertical arm connected to the rotary arm and a vertically movable vertical arm (34) linked to the fixed arm; a cable follower (40) connected to the bottom end of the vertically movable arm by means of a rod (19) articulated thereto; said cable follower being vertically movable by the parallelogram linkage and horizontally movable by said rod; and a cable tractor (15) supported by the parallelogram linkage and serving to regulate the speed of the cable as a function of the inward or outward direction of spiral winding for any given layer.

9 Claims, 14 Drawing Figures

AUTOMATIC MACHINE FOR COILING DOWN CABLE

The present invention relates to an automatic machine for coiling down cable in successive layers in a cylindrical tank having a vertical axis.

BACKGROUND OF THE INVENTION

During cable manufacture, and in particular when manufacturing electric cables, it is necessary to store partially fabricated lengths from one operation before passing on to a subsequent operation.

Such storage serves, for example, to mitigate the effects of differences in operating speed between assembly lines for performing successive operations on a cable. Furthermore, it provides "slack", enabling a repair to be performed on the site of some incident in one assembly line without having to stop the entire manufacturing operation.

All the processes in cable manufacture have been automated except for coiling down, ie. the operation of filling a cable tank with cable by winding coils of cable outwardly on one layer then inwardly on the next layer and so on to build up plane layers of spiraling cable until the tank is full. To ensure that the turns are contiguous, it is necessary for a coiler to push on the cable while it is being coiled inwardly and to pull on it while it is being coiled outwardly.

At present this operation of coiling down is performed entirely manually, including one or more coilers working inside the tank. The job is monotonous and unrewarding. Further, to ensure that it is performed properly, operators have to be replaced at frequent intervals. It is becoming difficult to find personnel willing to work under such conditions.

Semi-automatic machines for coiling down have already been proposed which either enable the number of operators or coilers handling the cable to be reduced, or else lighten the load when heavy cable is being coiled. However, in either case, these semi-automatic machines still require personnel to work at the bottom of the tank.

Preferred embodiments of the present invention enable human intervention to be dispensed with for substantially the entire period it takes to fill a tank, say three days. A coiler may still be required to assist the machine while the first few turns are being laid, and then again when the tank is filled up. Nevertheless, a single coiler can thus supervise a plurality of machines.

SUMMARY OF THE INVENTION

The present invention provides an automatic machine for coiling down successive layers of cable in a cylindrical tank having a vertical axis, the improvement wherein the machine comprises:

a movable beam to enable coiling down to take place in a selected one from a plurality of tanks;

a rotary arm suspended from the beam and rotatable about an axis which is movable by the beam into alignment with the axis of said selected tank;

a parallelogram linkage fixed to the free end of the rotary arm, said parallelogram linkage including a vertically fixed vertical arm connected to the rotary arm and a vertically movable vertical arm linked to the fixed arm;

a cable follower connected to the bottom end of the vertically movable arm by means of a rod articulated thereto; said cable follower being vertically movable by the parallelogram linkage and horizontally movable by said rod; and a cable tractor supported by the parallelogram linkage and serving to regulate the speed of the cable as a function of the inward or outward direction of spiral winding for any given layer;

said members being provided with actuator means such as motors and jacks to enable said movements to be remotely controlled, and with position sensors and motion sensors for sensing data which is applied to a computer for controlling and synchronizing said actuator means.

The machine preferably includes at least one of the following features:

said beam is pivotally mounted on a wall to swing jib-like between four positions: a first rest position against the wall; a first working position over a first tank; a second working position over a second tank; and a second rest position against the wall;

a cable loop controlling arm is mounted on the rotary arm, and preferably possesses cable guide rings;

a lifting jack is fitted to the free end of the rotary arm to tilt the parallelogram linkage when it is fully retracted;

the parallelogram linkage rests against the bottom of a tank or on previously laid down layers of cable by means of a wheel;

the follower rests against the bottom of a tank or on previously laid down layers of cable by means of a pressure wheel;

the follower has two sets of cable guides for pushing sideways against the turn of cable currently being laid, one or other of the sets being selected as a function of the direction in which the layer is being wound;

the tractor is declutchable.

BRIEF DESCRIPTION OF THE DRAWINGS

An embodiment of the invention is described by way of example with reference to the accompanying drawings, in which.

MORE DETAILED DESCRIPTION

Figure 1:
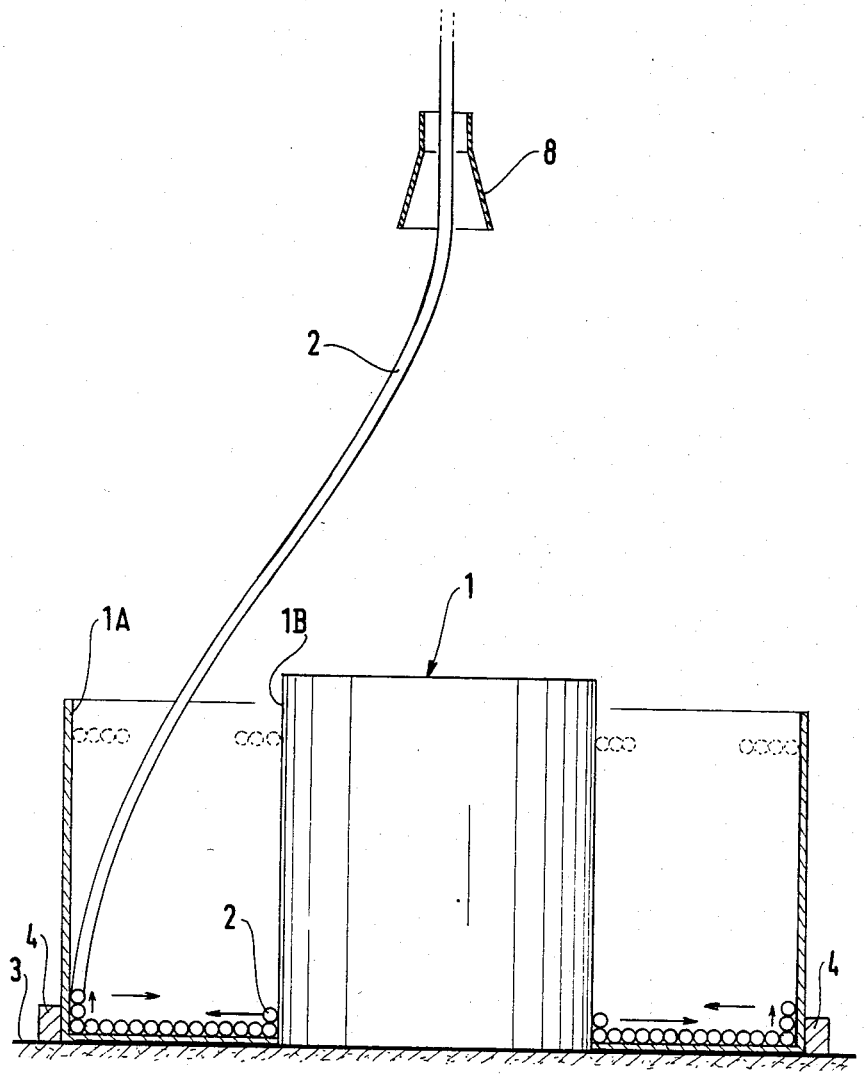
FIG. 1 is a diagram showing the principle by which successive layers are laid down in a tank.

FIG. 1 shows a tank 1 having an outer cylindrical wall 1A, an inner wall 1B co-axial with the outer wall and a base 3 fitted with centering blocks 4 for locating the tank. At the outlet from a production line, a cable 2 is drawn by tracks (not shown) which operate in synchronism with the line. The cable 2 is fed towards the tank via a downwardly flared funnel 8 located above the tank and on its axis. The cable follows a swan-neck path from the funnel to be laid in horizontal coils inside the tank. It is then laid in succesive layers until it reaches a level where the tank is deemed to be full.

Figure 2:
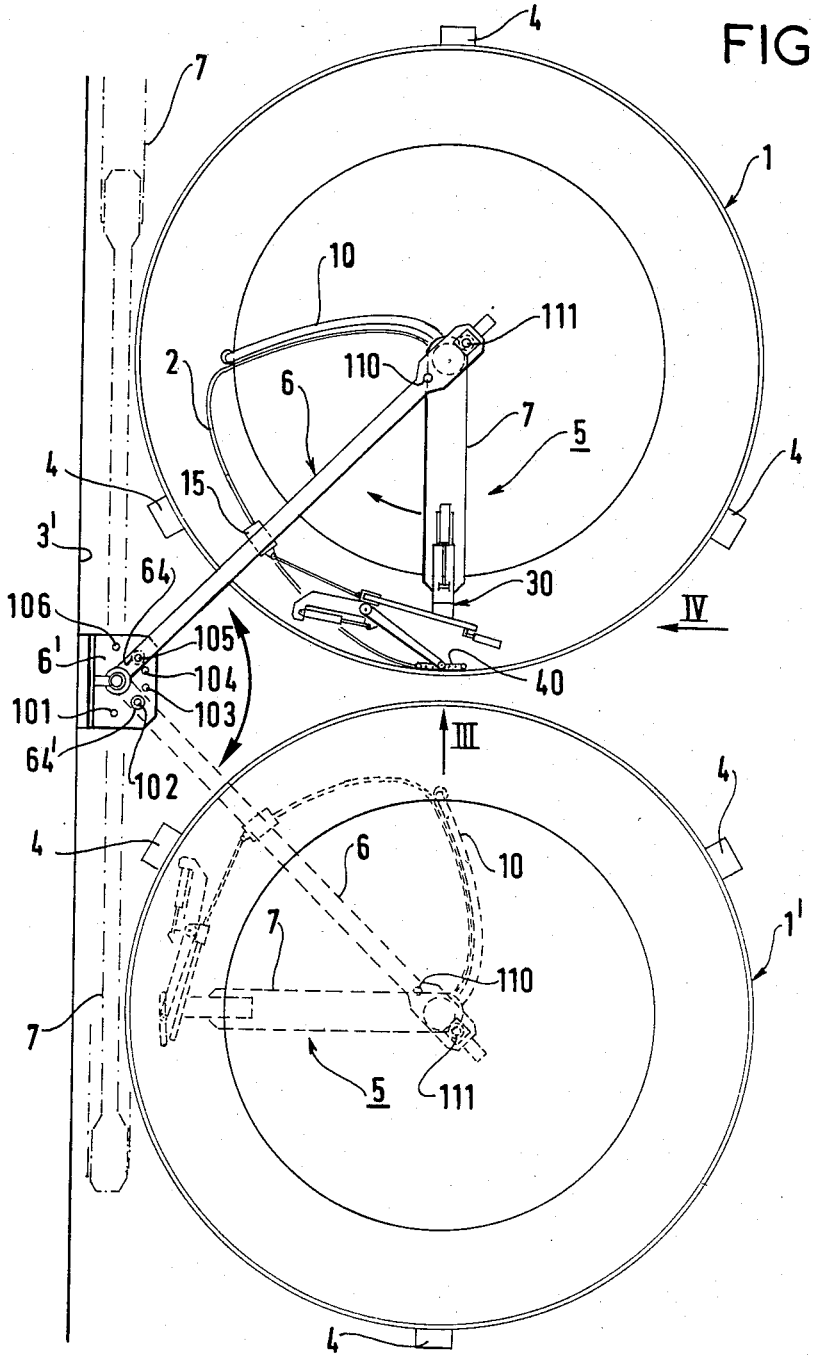
FIG. 2 is a plan view of a coiling down station comprising a coiling down machine in accordance with the invention and having two tanks between which it alternates.

FIG. 2 shows the cable 2 and the coiling down machine 5 seen from above. The machine 5 comprises a horizontally extending jib beam 6 which is fixed at one end to a wall 3' by means of a support 6' including a vertical axis about which the jib beam 6 may be swung. In operation the free end of the beam 6 takes up a position above the tank and on its axis. A radial arm 7 is suspended from the free end of the beam 6 and is rotatable about a vertical axis. A parallelogram linkage 30 (see FIG. 3) is suspended from the free end of the arm 7. A declutchable tractor 15 and a follower 40 are connected to the bottom of the parallelogram linkage 30. A cable loop arm 10 is also suspended from the free end of the beam 6 and keeps a constant station of about one fourth of a turn ahead of the radial arm 7.

FIG. 2 also shows how the tanks 1 and 1' are centered by the blocks 4. The jib beam may be swung into an operative position over either tank, and to hold it in position, the support 6' is provided with a plate having pin-receiving holes 64 and 64' corresponding to the tanks 1 and 1' respectively. In order to keep the winding down machine running continuously, it is swung away from a recently filled tank to start filling an empty tank. While the new tank is being filled, the filled tank may be removed and replaced with another empty tank.

The support 6' is fitted with beam position sensors 101 to 106 enabling the position of the beam to be monitored during both clockwise and anticlockwise swings.

The sensors 101 and 106 correspond to extreme positions in which the beam is placed against the wall 3' out of the way (shown in chain dotted lines). Similar position sensors 110 and 111 are provided at the free end of the beam 6 to indicate when the rotary arm 7 is parallel to the beam 6, either coming back underneath the beam (sensor 110) or else extending the beam (sensor 111). This is to ensure that the cable loop arm 10 projects away from the wall 3' when the beam 6 is placed against the wall.

The sensors 103 and 104 are to determine when to stop accelerating the beam in its movement from one operating position to the other, prior to arrival at the appropriate pin-receiving hole 64 or 64'.

The sensor 102 corresponds to the hole 64' and the sensor 105 corresponds to the hole 64.

Figure 3:
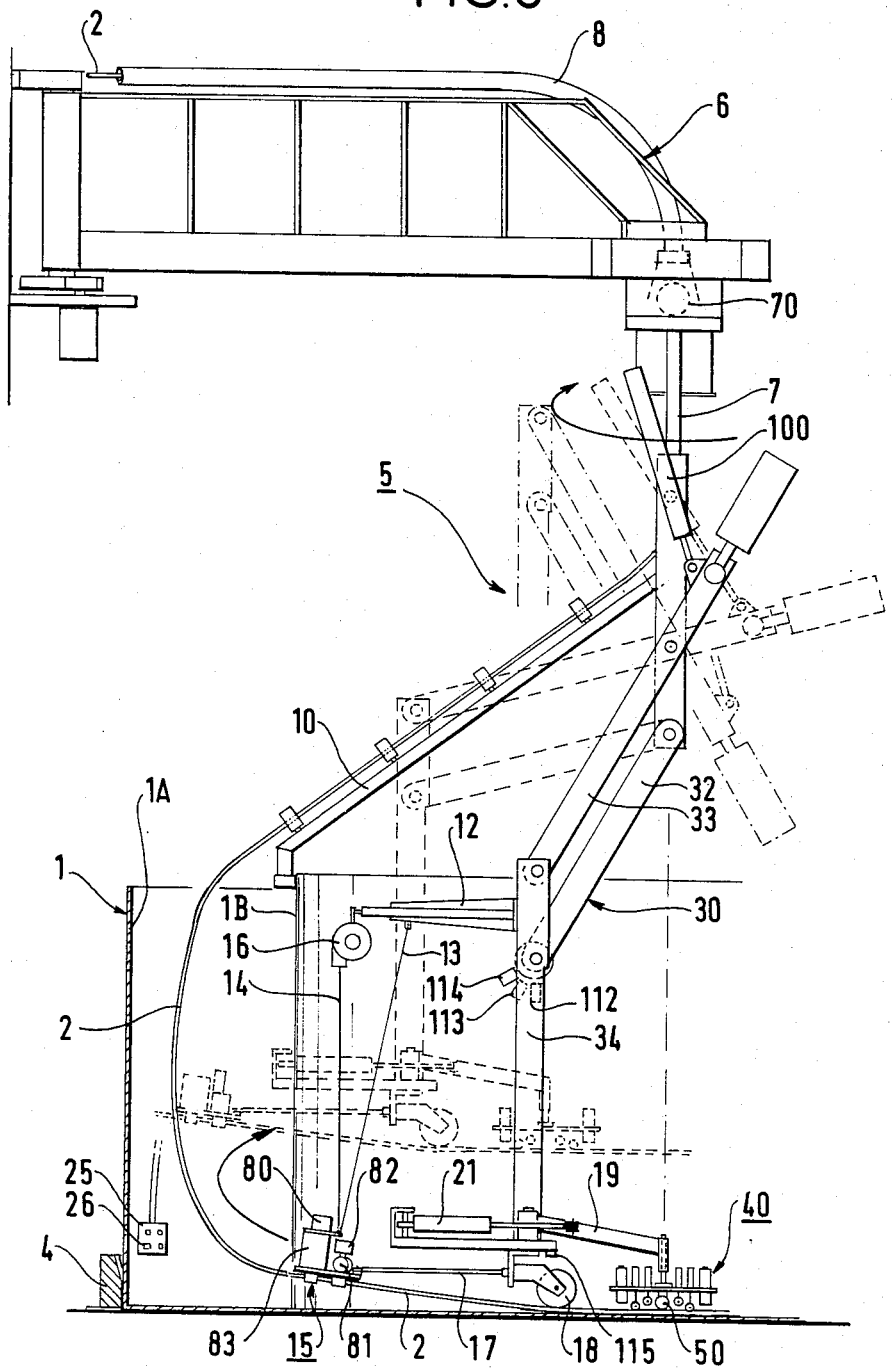
FIG. 3 is a side view of the machine shown in FIG. 2 as seen along an arrow III, the outer wall of a tank has been removed to show the machine in three different positions: a tank bottom position in unbroken lines, an intermediate position in dashed lines, and a topmost position for a parallelogram linkage shown in chain dotted lines.

FIG. 3 is a side view of the coiling down machine. The radial arm 7 (better seen in FIG. 4) is extending radially towards the observer of FIG. 3. The parallelogram linkage 30 fixed to the free end of the arm 7 comprises a fixed vertical arm 31, two parallel links 32 and 33 and a moving vertical arm 34 at the free end of the links. The parallelogram linkage enables coiling down to be performed under similar conditions regardless of whether the tank is nearly empty, half full or nearly full. The vertical position of the moving arm 34 is determined by a jack 100. The tractor 15 is suspended by means of a winch 16 mounted at the end of a small cantelever beam 12 projecting from the top of the moving arm 34. A suspension cable 14 is wound on the winch 16, and tractor position is furthur maintained by a second suspension cable 13 connected to an intermediate point along the beam 12 and by a stiff rod 17 extending horizontally from the bottom of the moving arm 34. The tractor comprises a motor 80, a torque limiter 83, a tachometer dynamo 82 and a tightening jack 81. The tractor pulls or pushes the cable by varying the speed of the motor 80 as a function of the direction in which a coil is being laid. As in manual coiling down, the tractor pushes the cable in the opposite direction to the direction of rotation of the arm 7 when the cable is being spiralled inwardly, and it pulls the cable in the direction of arm rotation when the cable is being spiralled outwardly, thereby avoiding gaps between turns.

The moving vertical arm 34 presses against the bottom of the tank by means of a wheel 18 made of hard elastomer.

Three position sensors 112, 113 and 114 serve to signal the vertical position of the arm 34.

A position sensor 115 detects when the parallelogram changes layers.

The follower 40 is connected to the arm 34 by a bar 19 which is articulated to the arm 34. The follower serves to position the cable in spiral turns which are regular and contiguous. The cable loop arm 10 is fixed to the rotary arm 7 and has its free end guided by the rim of the inside wall 1B of the tank. It serves to guide the cable from where it leaves the funnel 8 up to the edge of the tank. A manual control panel 25 with control buttons 26 is provided inside the tank to enable a coiler to provide manual assistance to the machine when starting to fill an empty tank.

Figure 4:
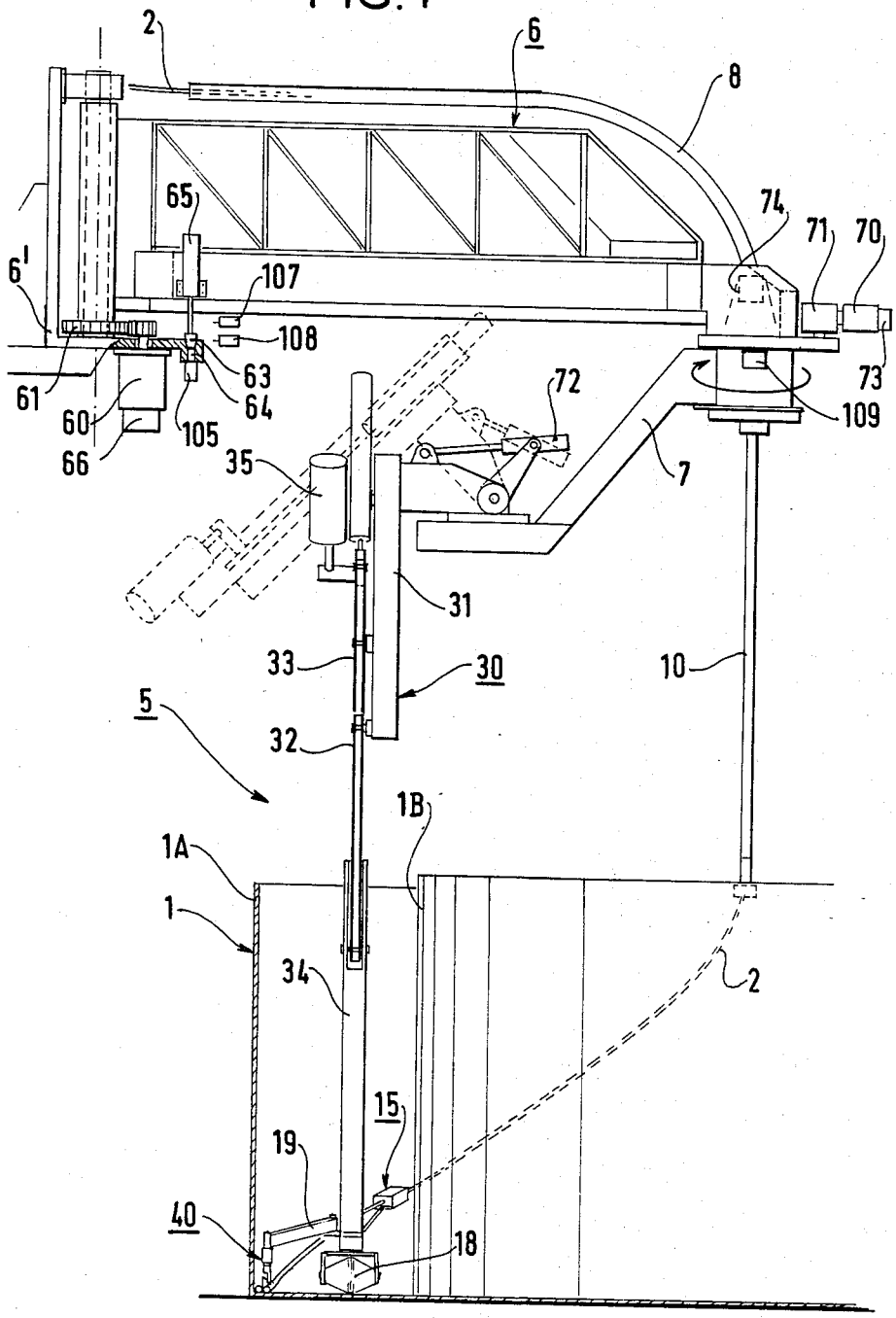
FIG. 4 is a front view of the machine shown in FIG. 2 as seen along an arrow IV, the outer wall of the tank has been removed to show the machine in two different positions: a tank bottom position in full lines and a tilted up position for changing tanks in dashed lines.

FIG. 4 is a view of the coiling down machine showing the components inside the tank moving away from the observer. It also shows details of the jib beam mounting. The beam 6 is swung by means of a motor 60 driving gears 61. A tachometer generator 66 is associated with the motor 60. Accurate angular positioning of the beam 6 relative to the tanks is ensured by means of a pin 63 which is driven into an appropriate one of the pin-receiving holes 64 or 64' by a jack 65. The sensor 105 indicates when the beam 6 is properly positioned over the tank 1, and sensors 107 and 108 indicate the position of the pin 63. (the sensor 107 indicating that pin is retracted away from the holes and the sensor 108 that it is engaged in a hole). The pin 63 is slightly conical to facilitate hole engagement.

The rotary arm 7 is rotated at the free end of the jib beam 6 by means of a motor 70 and a transmission gear 71. A tachometer generator 73 is associated with the motor 70.

Another tachometer generator 74 indicates the speed at which cable is passing through the funnel 8. An angular position sensor 109 indicates the angular position of the arm 7 relative to the jib beam 6.

The parallelogram linkage 30 at the end of the arm 7 can be fully extended downwards to reach the bottom of the tank and fully retracted upward to clear the top of the tank under the control of the jack 100. A counterweight 35 is fixed to the parallelogram linkage close to its connection to the jack 100.

To clear the top of the tank more completely, the entire parallelogram linkage is mounted to be tilted by a jack 72, as shown in dashed lines. The wheel 18 is fixed to the bottom end of the moving arm 34, the follower 40 is hinged to the bar 19, and the tractor 15 pulls the cable 2 as guided by the arm 10 on its path from the funnel 8 to the rim of the drum.

Figure 5:
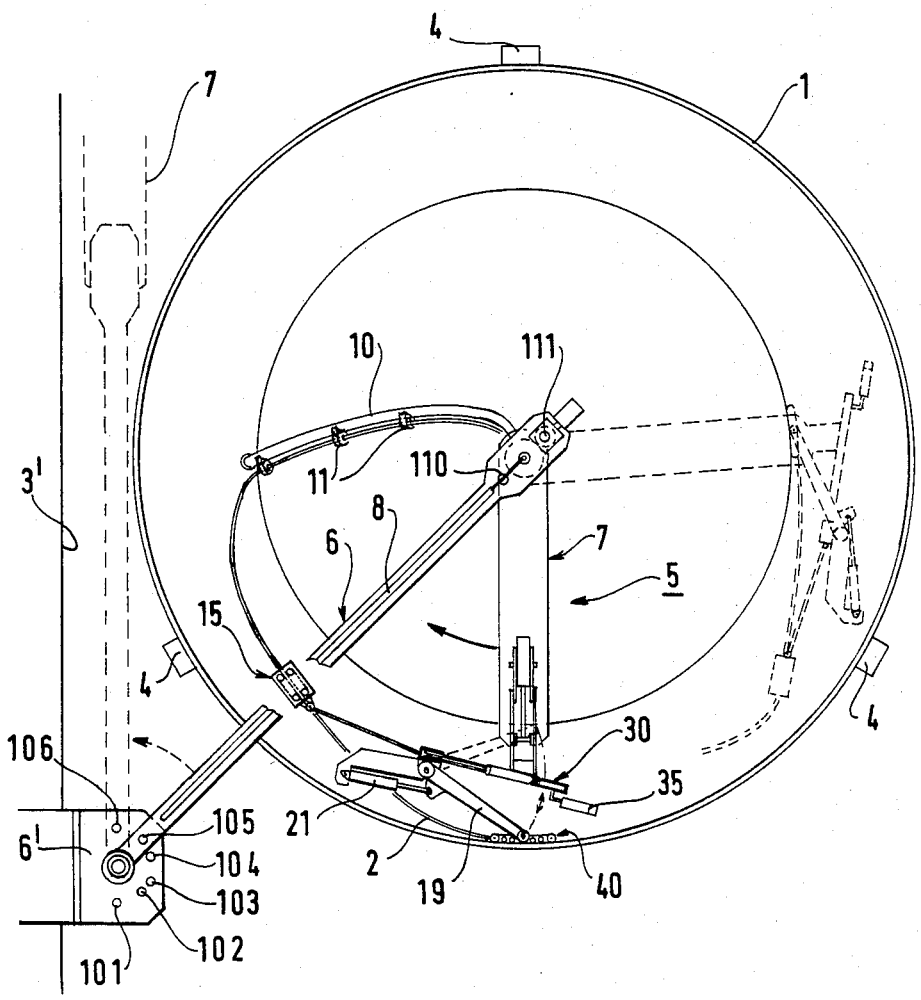
FIG. 5 shows a portion of FIG. 2 to a larger scale.

FIG. 5 shows the jib beam 6 supporting the rotary arm 7, the cable loop guide arm 10 together with its guide rings 11, the parallelogram linkage 30 and the articulated bar 19 on which the follower 40 is mounted. The articulated bar 19 is moved by a jack 21.

The figure also shows the two position sensors 110 and 111 which indicate the position of the rotary arm 7 relative to the jib beam 6 to enable the arm to be properly positioned when the beam 6 is placed in either of its rest positions against the wall 3'. The sensor 111 indicates that the arm 7 is extending the beam 6, ie. is suitably positioned for putting the beam against the wall in an anticlockwise direction as shown in dashed lines.

The cable 2 is pulled by tracks (not shown) situated at the end of the manufacturing line and operated in synchronism therewith. The cable then passes along the beam 6, through the funnel 8, along the arm 10 through its guide rings 11, along an unsupported curve to the tractor 15, and finally on to the follower 40 where it is wound into contiguous turns in the tank 1.

Figure 6:
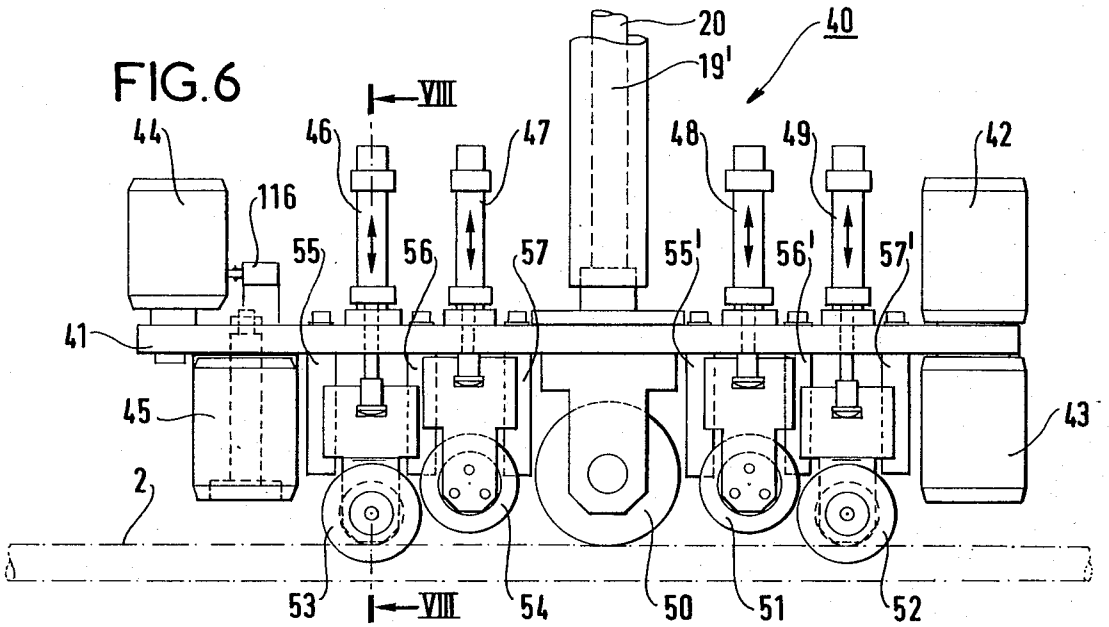
FIG. 6 shows a follower shown in FIG. 3 but to a larger scale.

FIG. 6 shows the follower 40. It is pivoted to the end of the articulated bar 19 by means of a sleeve 19' on the bar which surrounds a vertical spindle 20 on the follower. The follower is built around a support plate 41 and comprises a wheel 50 for pressing down on the cable 2, an outer pair of jacks 47 and 48 for actuating respective cable guides 54 and 51, an inner pair of jacks 46 and 49 for actuating respective cable guides 53 and 52, and four bearing rollers 42 and 45 which bear against the inside surface of the outside wall 1A of the tank 1. Each of the cable guides 51 to 54 is vertically movable by the associated jack and is slidably mounted between a pair of adjacent vertical rods. A leading group of three rods 55, 56 and 57 guide the cable guides 53 and 54 while a trailing group of three rods 55', 56' and 57' guide the cable guides 51 and 52. The guide rods and the jacks are fixed to the support plate 41. A position sensor 116 indicates when the the follower has reached either the inside or the outside wall of the tank. It operates by sensing when the bearing roller 44 is turning.

Figure 7:
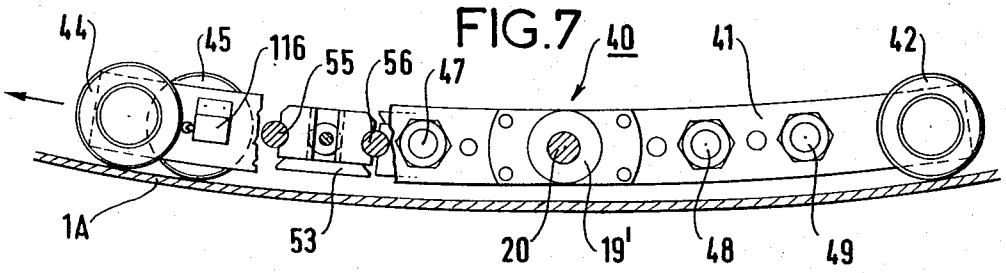
FIG. 7 shows the FIG. 3 follower seen from above while pressing against the inside face of the outside wall of the tank.

FIG. 7 is a partially cut-away plan view of the follower described with reference to FIG. 6, and showing in greater detail how the guide rods co-operate with the guide wheels for vertical movement of the wheels.

Figure 8:
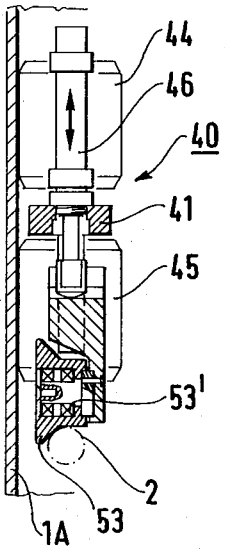
FIG. 8 is a section through the follower along a line VIII in FIG. 6.

FIG. 8 is a vertical section through the same follower, showing how the bearing rollers come into contact with the tank wall 1A and also the shape of the guide wheels which are mounted on ball bearings and which co-operate with the cable as it is being laid in a manner similar to that of a railway wheel co-operating with a rail.

Figure 9:
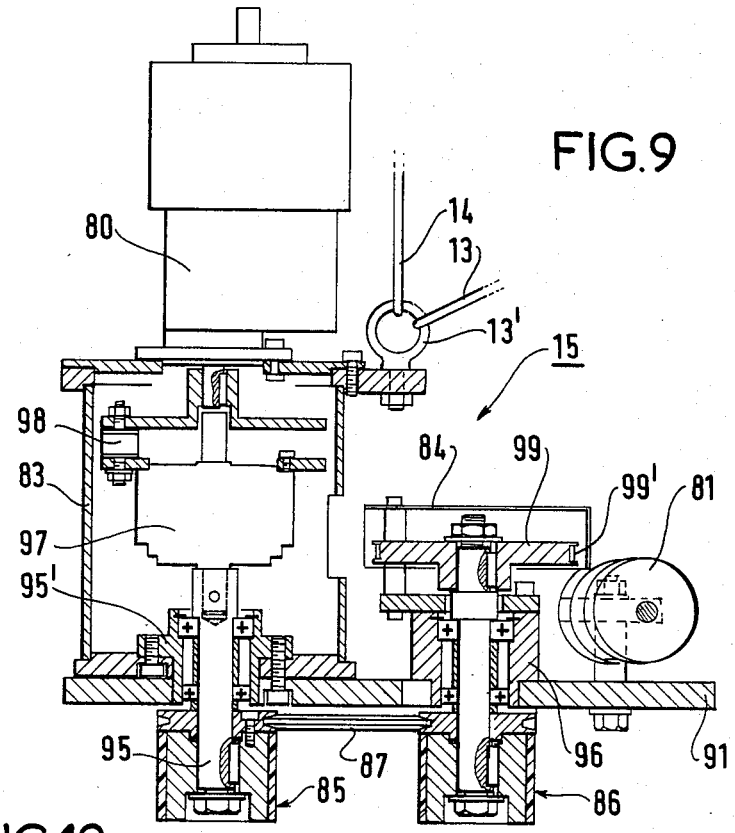
FIG. 9 shows a tractor shown in FIG. 3 in section along a line IX of FIG. 10, this figure shows the tractor motor and its device for driving a tachymeter dynamo.

FIG. 9 is longitudinal section through the tractor 15. A support eye 13' is attached to the end of the suspension cable 13 whose other end is fixed to the cantelever 12 on the parallelogram linkage and to the end of the suspension cable 14 whose other end is wound round the winch 16 (see FIG. 3).

The tractor comprises a motor 80 driving a torque limiter 83 which includes a drum 97 and a damper 98. The torque limiter serves as a safety device in the event of the cable slipping, and it drives a first cable driving wheel 85 by means of a shaft 95. A belt 87 couples the first drive wheel 85 to a second drive wheel 86 and the cable being driven is pinched between these two drive wheels and two pinch wheels described below with reference to FIG. 10. The drive wheels and the pinch wheels are covered with elastomer tires to increase their grip on the cable. The second drive wheel 86 is mounted on a shaft which rotates a disk 99 inside a cover 84. The disk 99 drives a belt 99' which turns the tachometer 82 (not shown in this figure). Both shafts 95 and 96 are mounted on ball bearings which are mounted on a support plate 91 by means of ball bearing cages 95' and 96' respectively.

Figure 10:
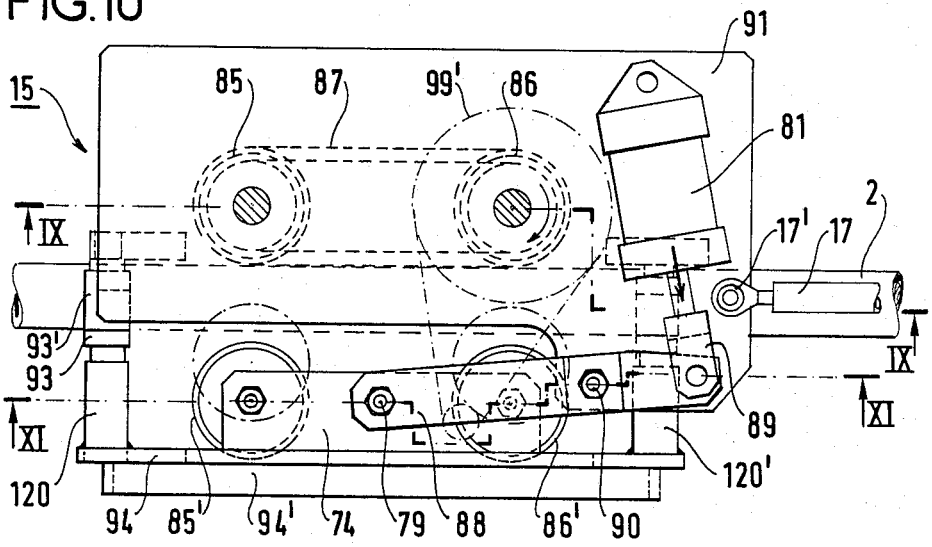
FIG. 10 shows the same tractor seen from above and without its motor and tachymeter dynamo.

FIG. 10 shows the tractor 15 seen from above (with the upper components removed) to show the means for pinching the cable 2 while it is being driven by the tractor. The bar 17 coming from the bottom end of the parallelogram linkage (see FIG. 3) is fixed to a knuckle joint 17' on the support plate 91. The jack 81 moves a fork 89 to move one end of a lever 88 which is pivoted at an intermediate point about a shaft 90. The other end of the lever 88 is pivotally mounted on a support plate 74 which supports the said pinch wheels 85' and 86' which are free to rotate. The support plate 74 also has a side plate 94 running paralell to the cable 2 and reinforced by a rib 94'. At each end of the side plate 94 there are upstream and downstream rollers 92 and 93 for guiding the underside of the cable 2. These rollers are better seen in FIGS. 11 and 12 and they are mounted at the end of supports 120 and 120'. They co-operate with upstream and downstream rollers 92' and 93' which are mounted on the support plate 91 and which engage the top surface of the cable.

FIG. 10 also shows the belt 99' in a chain dotted line.

Figure 11:
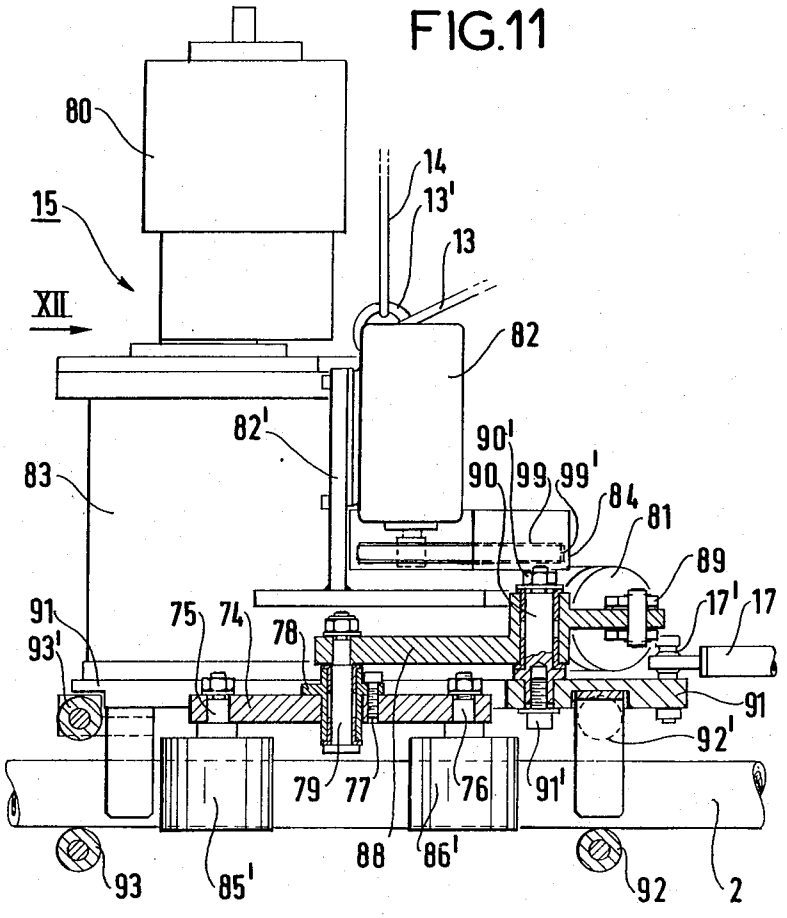
FIG. 11 shows the same tractor in section along a line XI in FIG. 10.

FIG. 11 is a vertical section through the pinch wheel assembly showing the jack 81, its fork 89, the lever 88, and the lever shaft 90 connected to the support plate 91 by a screw 91'. A nut 90' prevents the lever 88 from moving up and down the shaft 90. The free end of the lever 88 is connected to the support plate 74 by a pin 79 which is free to pivot in a sleeve 78 mounted on the plate 74 by means of a screw 77. The pinch wheels 85' and 86' are free to rotate on the support 74 about respective shafts 75 and 76.

The upstream and downstream guide rollers 93 and 93' and 92 and 92' can also been seen, as can the belt 99' protected by its cover 84, and the tachometer dynamo 82 driven thereby.

The dynamo 82 is mounted on a support plate 82'.

Figure 12:
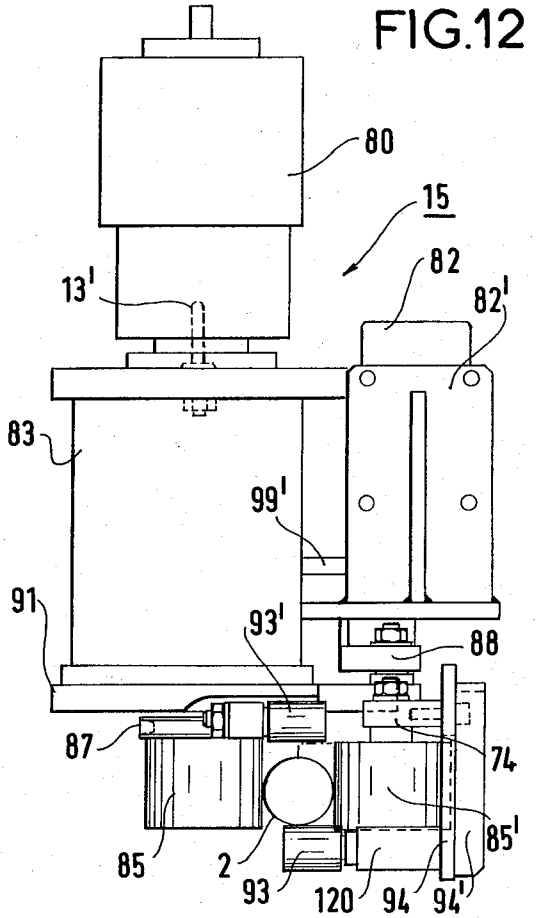
FIG. 12 shows the same tractor in elevation along an arrow XII in FIG. 11.

FIG. 12 is an end view of the tractor looking from the upstream end. It can be seen that the upstream rollers 93 and 93' enable cables of different diameters to be securely held by the tractor. The support 74, its side plate 94, a reinforcing rib 94' and a roller support 120 can also be seen clearly.

This figure also shows the support plate 91, the belt 87, the torque limiter 83, the motor 80, the eye 13', the support plate 82', and the tachometer dynamo 82.

Figure 13:
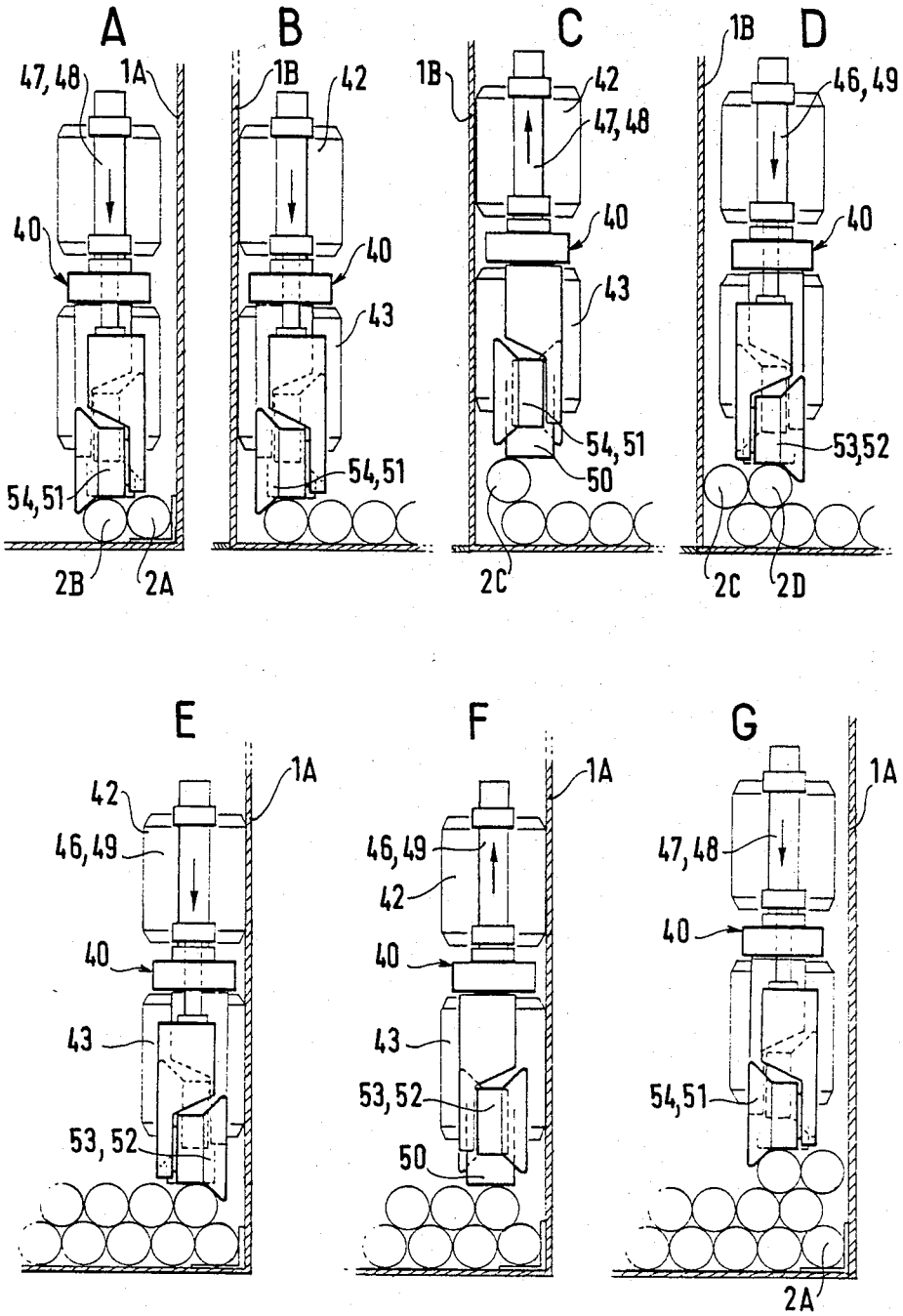
FIG. 13 shows the FIG. 3 machine in with its cable guides in successive different positions taken up during coiling down.

FIG. 13 shows different steps in the coiling down process, beginning with laying the first layer which is laid spirally moving inwards from the outer wall 1A, then the second layer which spirals outwardly, a third layer which spirals back inwardly, and so on. Unlike the preceding figures which show the outer wall to the left of the figure, FIG. 13 shows the outer wall to the right and the inner wall to the left.

Stage A: The operator unwinds the first turn inside the tank 1 and lays it against the outside wall 1A. The follower 40 is placed on the first turn 2A of the cable 2, and the machine is then used under direct manual control to lay the second turn 2B. The next few turns are also laid under manual control to ensure that various adjustments are properly set. Thereafter the machine can lay following turns automatically without operator intervention. The inner cable guides 51 and 54 press each succeeding inside turn against the adjacent outer turn, eg. the turn 2B against the turn 2A.

Stage B: When the first layer is complete, the follower 40 abuts against the inside wall 1B of the tank 1.

Stage C: The follower 40 is lifted by the thickness of one layer of cable and the first turn 2C of the second layer is laid with the pressure wheel 50 pressing downwards on the turn 2C. The inner cable guide wheels 51 and 54 are retracted.

Stage D: The outer cable guide wheels 52 and 53 are lowered and press each succeeding outside turn against the adjacent inner turn.

Stage E: When the second layer is complete the follower 40 abuts against the outside wall 1A of the tank.

Stage F: The outer guide wheels 52 and 53 are retracted.

Stage G: The inner guide wheels 51 and 54 are lowered and again serve to press each new turn outwardly as it is being laid.

The process repeats until the tank is full, which typically takes about 87 hours.

Figure 14:
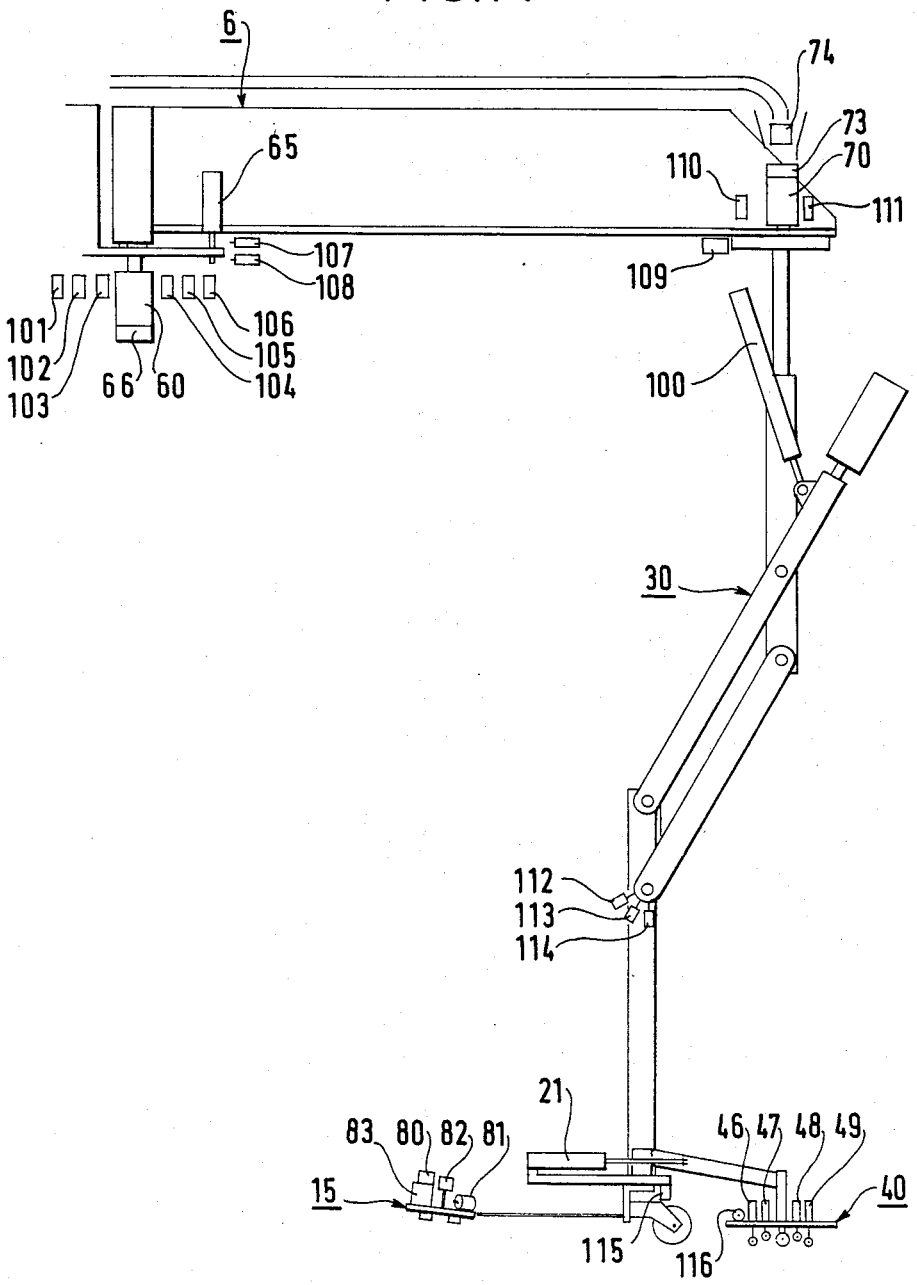
FIG. 14 is a diagram showing the various controlling, driving, and monitoring devices used in said machine.

FIG. 14 is an outline diagram summarizing the driving, controlling and sensing components of the machine.

The motor 60 swings the jib beam 6, and the associated tachometer 66 enables its swing speed to be accelerated and decelerated smoothly. Six position sensors located on the support 6' indicate the position of the beam 6:

The sensor 101 fixes the clockwise position for storage.

The sensor 102 fixes the clockwise position for coiling.

The sensor 103 fixes the clockwise position for stopping acceleration.

The sensor 104 fixes the anticlockwise position for stopping acceleration.

The sensor 105 fixes the anticlockwise position for coiling.

The sensor 106 fixes the anticlockwise position for storage.

The jack 65 locks the beam in a desired angular position.

The sensor 107 detects when the locking jack 65 is up, and the sensor 108 detects when it is down, ie. locking the beam.

The motor 70 drives the rotary arm 7, and the associated tachometer 73 is used when under manual control and when changing over from manual control to automatic operation to ensure that speed is increased smoothly.

The tachometer 74 indicates the speed at which the cable is leaving the funnel 8, and this information is applied to the motor 70.

The sensor 109 indicates the angular position of the rotary arm 7, and consequently enables the speed of rotation of the arm to be derived.

The sensor 110 is a position sensor for indicating that the rotary arm is correctly positioned relative to the beam for storage in the clockwise position.

The sensor 111 is a position sensor for indicating that the rotary arm is correctly positioned relative to the beam for storage in the anticlockwise position.

The jack 100 raises and lowers the parallelogram linkage 30. Three position sensors 112, 113 and 114 placed on the parallelogram linkage at the pivot between the lower link 32 and the moving vertical arm 34 serve to indicate the depth of the moving arm inside the tank. The motor 80 drives the wheels of the tractor 15. The torque limiter 83 is associated therewith. The jack 81 clamps the tractor to the cable by means of the tractor's drive wheels and pinch wheels. The tachometer 82 indicates the speed at which the cable is passing through the tractor 15.

The rotary jack 21 moves the follower 40 between extreme positions where it is in contact with the outer wall or the inner wall of the tank 1.

The outer jacks 46 and 49 place the cable guide wheels for winding a spiral outwardly from the inner wall towards the outer wall.

The inner jacks 47 and 48 place the cable guide wheels for winding a spiral inwardly from the outer wall towards the inner wall.

The sensor 115 detects a change of layer and it causes the cable guide wheels to be swapped over by means of the jacks 46 to 49.

The sensor 116 is a sensor for detecting when the roller 44 abuts against one or other of the tank walls, thereby indicating the end of a layer and controlling the jack 21 to reverse the direction in which it swings the bar 19.

The machine operates as follows:

Once an empty tank is in place, a station supervisor in an external control booth causes the beam 6 to swing into position under the force of the motor 60. The position sensors 104 and 105 monitor the swing, and as soon as the beam is in place over the empty tank, the jack 65 engages the pin 63 in the hole 64 and the beam is thus locked in its working position.

A coiler goes down into the tank, unlocks the funnel and lays a first turn by hand against the outer wall 1A of the tank. Once this first turn is in place the coiler asks the supervisor to lower the parallelogram linkage by activating the motor 100, so that he can place the follower 40 on the bottom of the tank and then against the single turn of cable. After choosing the direction of rotation, the coiler uses the control panel to drive the machine under manual control and all the following actions are stored in the memory of a controlling computer.

The coiler causes the jacks 47 and 48 to lower the cable guides 51 and 54, and causes the pneumatically controlled rotary jack 21 to push successive turns outwardly so that they are contiguous.

The coiler moves the rotary arm 7 under the control of the motor 70 and varies the speed of rotation to obtain a properly laid second turn.

The coiler also places the cable in the tractor and clamps the tractor on the cable by means of the jack 81. The speed of the tractor is adjusted to obtain a properly laid coil.

Once satisfied with the settings, the coiler sets the machine to automatic operation and leaves the tank.

While operating automatically, the speed at which the cable arrives through the funnel 8 is monitored by the tachometer 74, and this information is used to control the motor 70, while the speed of the cable leaving the tractor is monitored by the tachometer 82. These two speeds must be synchronized. The speed of arm rotation is obtained by differentiating the information obtained by the position sensor 109 as a function of time, and this must be synchronized to the linear speed of the cable.

These speed parameters are applied to the computer which is programmed for given loop lengths as a function of cable stiffness and the depth reached by the coiling down process.

The depth of cable already coiled down is indicated by the sensors 112, 113 and 114, and the computer modifies the loop length as a function of depth, say once ever 300 mm.

The follower 40 is fitted with a magnetic sensor 116 and causes the force applied by the rotary jack 21 to be cancelled as soon as the follower reaches the inner wall 1B of the tank, the follower is then raised by the thickness of one layer of cable, while the sensor 115 controls the swapping over of the cable guides.

The cable guides 51 and 54 are retracted by the jacks 47 and 48 while the cable guides 52 and 53 are lowered into the working position by the jacks 46 and 49. The force exerted by the rotary jack 21 is reversed in direction in comparison with the first layer.

After the second layer has been formed, the follower is back substantially in its initial position against the outside wall of the tank, and the cycle of operations is repeated.

The sensors 115 and 116 supply information to the computer which serves to vary the pushing or pulling force applied to the cable.

When the tank is full, the coiler again intervenes, this time at the top of the tank, to perform the following operations:

(1) stop the arm;
(2) cancel the effect of the jack 21;
(3) fold up the parallelogram;
(4) disconnect the arm drive and lock the arm to the beam;
(5) cut the cable; and
(6) move the machine out of the way by swinging the beam.

If automatic operation cannot be performed because of a machine breakdown, coiling down may be continued manually by a coiler. The coiler enters the tank, and before starting manual coiling, must perform the following operations:

(1) disconnect opposing forces;
(2) open and disengage the tractor;
(3) fold up the parallelogram;
(4) stop the rotary arm from rotating; and
(5) lift up the rotary arm.

Without going beyond the scope of the invention, the coiling machine can be used with cables over a wide range of diameters, and in a variant, force sensors could be incorporated to provide finer control of the mechanical forces applied to the cable during a coiling down operation.

I claim:

1. An automatic machine for coiling down successive layers of cable in a cylindrical tank having a vertical axis, the improvement wherein the machine comprises:

a movable beam to enable coiling down to take place in a selected one from a plurality of tanks;

a rotary arm suspended from the beam and rotatable about an axis which is movable by the beam into alignment with the axis of said selected tank;

a parallelogram linkage fixed to the free end of the rotary arm, said parallelogram linkage including a vertically fixed vertical arm connected to the rotary arm and a vertically movable vertical arm linked to the fixed arm;

a cable follower connected to the bottom end of the vertically movable arm by means of a rod articulated thereto; said cable follower being vertically movable by the parallelogram linkage and horizontally movable by said rod; and a cable tractor supported by the parallelogram linkage and serving to regulate the speed of the cable as a function of the inward or outward direction of spiral winding for any given layer;

said members being provided with actuator means such as motors and jacks to enable said movements to be remotely controlled, and with position sensors and motion sensors for sensing data which is applied to a computer for controlling and synchronizing said actuator means.

2. An automatic coiling down machine according to claim 1, for filling a selected one of two tanks, wherein said beam is pivotally mounted on a wall to swing jib-like between four positions: a first rest position against the wall; a first working position over the first of said tanks; a second working position over the second of said tanks; and a second rest position against the wall.

3. An automatic coiling down machine according to claim 1, wherein a cable loop controlling arm is mounted on the rotary arm.

4. An automatic coiling down machine according to claim 4, wherein the cable loop controlling arm possesses guides.

5. An automatic coiling down machine according to claim 1, wherein a lifting jack is fitted to the free end of the rotary arm to tilt the parallelogram linkage when it is fully retracted.

6. An automatic coiling down machine according to claim 1, wherein the parallelogram linkage rests against the bottom of a tank or on previously laid down layers of cable by means of a wheel.

7. An automatic coiling down machine according to claim 1, wherein the follower rests against the bottom of a tank or on previously laid down layers of cable by means of a pressure wheel.

8. An automatic coiling down machine according to claim 1, wherein the follower has two sets of cable guides for pushing sideways against the turn of cable currently being laid, one or other of the sets being selected as a function of the direction in which the layer is being wound.

9. An automatic coiling down machine according to claim 1, wherein the tractor is declutchable.

* * * * *